United States Patent [19]

Headrick

[11] 4,298,911

[45] Nov. 3, 1981

[54] LIGHTING DEVICE FOR CREATING PUBLIC ATTRACTION

[75] Inventor: Richard T. Headrick, Irvine, Calif.

[73] Assignee: Pichel Industries, Inc., Rancho, Calif.

[21] Appl. No.: 144,369

[22] Filed: Apr. 28, 1980

Related U.S. Application Data

[63] Continuation-in-part of Ser. No. 98,864, Nov. 30, 1979, abandoned.

[51] Int. Cl.[3] ..... F21V 21/30

[52] U.S. Cl. ..... 362/35; 362/249; 362/252; 362/272

[58] Field of Search ..... 362/35, 227, 249, 252, 362/272

[56] References Cited

U.S. PATENT DOCUMENTS 2,345,382 3/1944 Cramer ..... 362/35

2,462,222 2/1949 Pennow ..... 362/35

*Primary Examiner*—Stephen J. Lechert, Jr.

*Attorney, Agent, or Firm*—Jackson, Jones & Price

[57] ABSTRACT

A lighting device which is well adapted for inviting public attention by a conspicuous and decorative display of bright lights, is disclosed. The device includes at least one light source which is moveably mounted to a base. A motor and drive mechanism including a bent shaft is operatively associated with the light sources to orbit each light source around a respective center point. In many embodiments of the invention the drive mechanism is also adapted for continuously varying the angular positioning of each light source and of the emitted rays of light relative to the vertical direction.

43 Claims, 16 Drawing Figures

FIG. 1
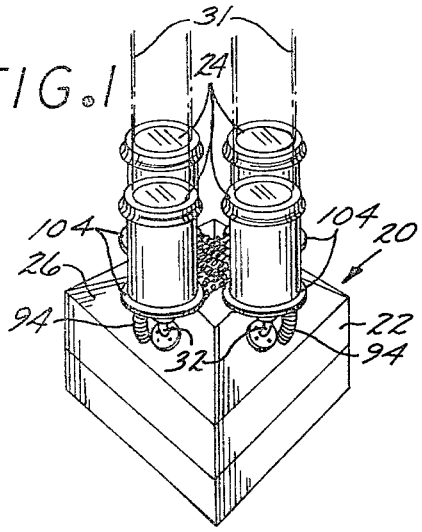
FIG. 2
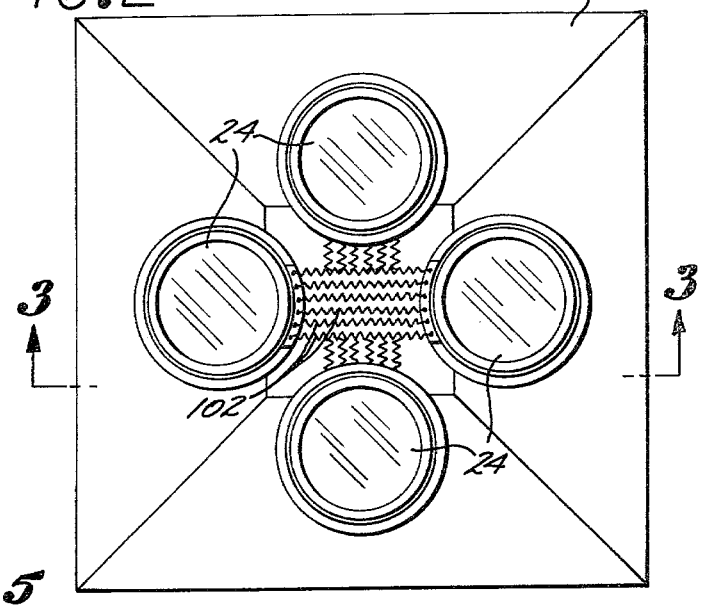
FIG. 3
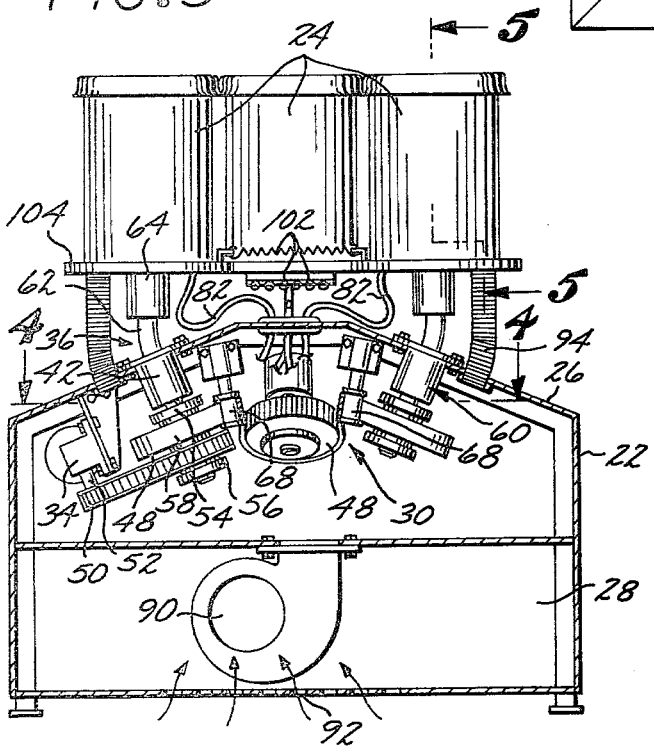
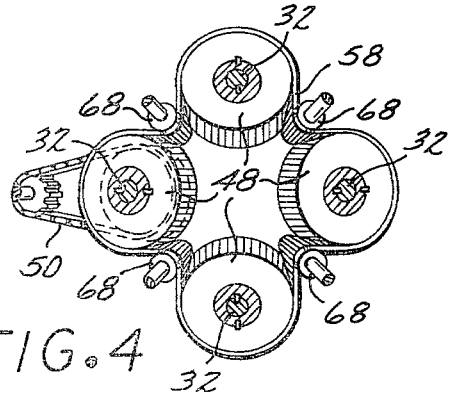
FIG. 4
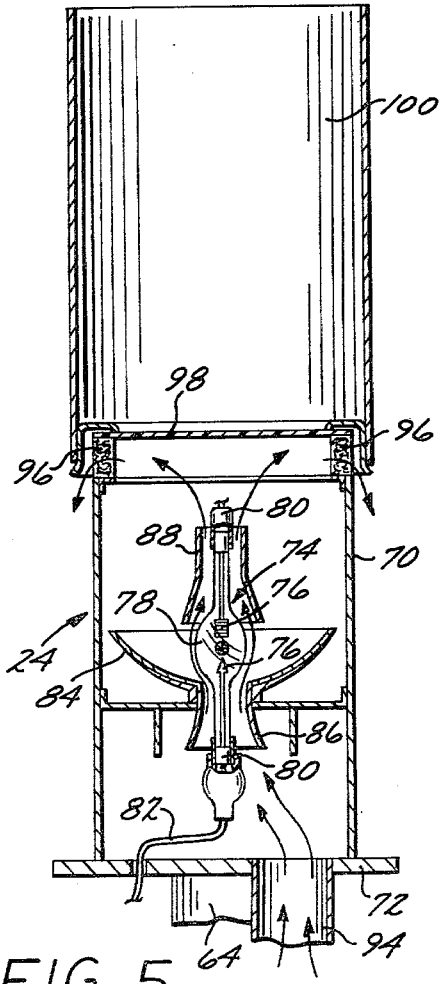
FIG. 5

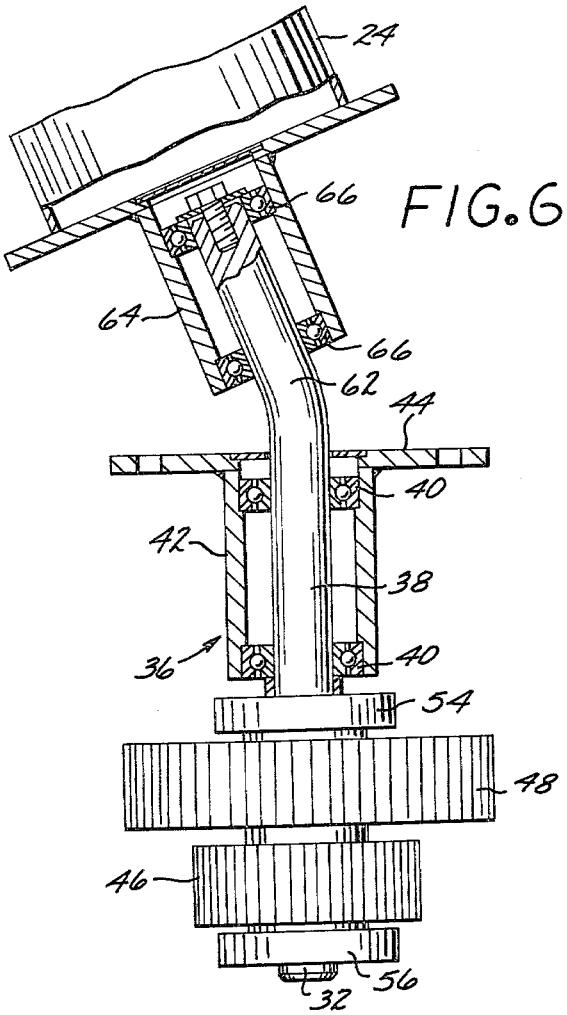
FIG. 6
FIG. 7
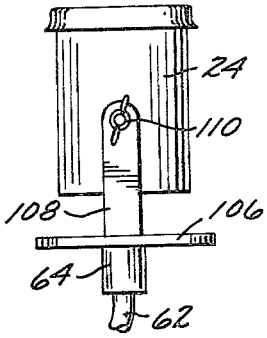
FIG. 8
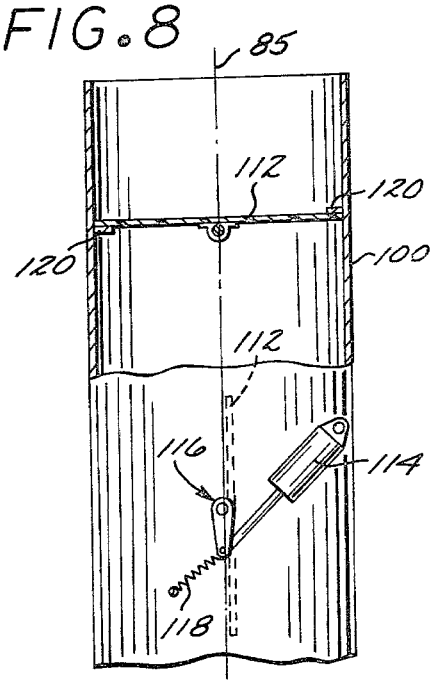
FIG. 9
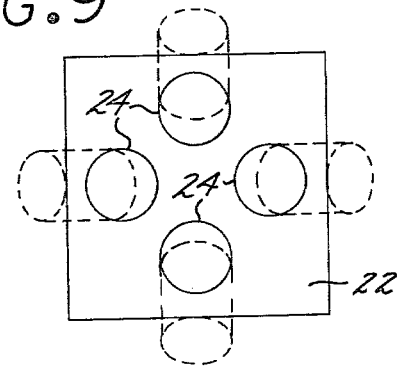
FIG. 10
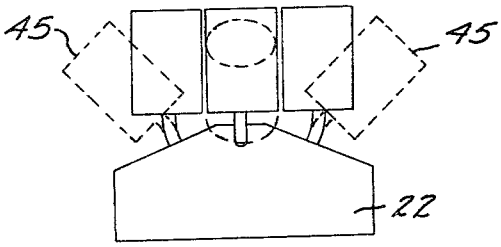
FIG. 11
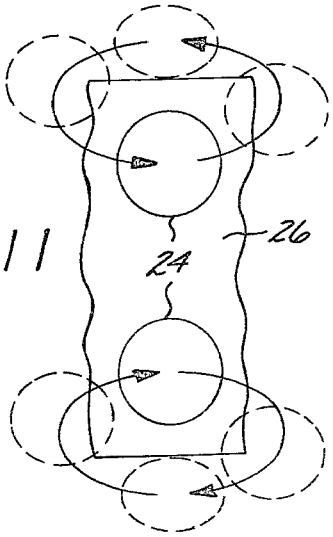

LIGHTING DEVICE FOR CREATING PUBLIC ATTRACTION

CROSS REFERENCE TO RELATED APPLICATION

The present application is a continuation-in-part of United States Patent Application Ser. No. 98,864 filed on Nov. 30, 1979, abandoned.

BACKGROUND OF THE INVENTION

1. Field of the Invention

The present invention relates to an improved lighting device which has at least one light source continuously moveable in a predetermined aesthetically pleasing unique pattern, and which is well adapted for providing a highly decorative display of light for creating attraction for the public.

2. Brief Description of the Prior Art

High intensity searchlights and beacons are well known in the prior art. A device comprising a very high intensity searchlight similar in construction to searchlights for enemy aircraft widely used in World War II, is currently in widespread commercial use for advertising and like purpose. More particularly, high intensity lights are currently in use for attracting public attention at movie theaters, shopping centers and similar places by shining a very bright light beam into the night sky.

The state-of-the-art high intensity lights currently used for inviting public attention are usually mounted for rotation relative to a stationary base about two mutually perpendicular axes so that the resulting light beam may be moved in several directions across the sky.

Serious shortcomings of the above described state-of-the-art high intensity lights are their relatively high power consumption and their continuous need for an attendant operator. In fact, the high intensity lights presently used for inviting public attention usually derive their power requirement from a hydrocarbon fuel powered portable generator associated with the light.

In addition to the above mentioned high intensity lights and beacons, a relatively large number of decorative or warning light displays were provided in the prior art wherein ordinary "low power input" lightbulbs of fluorescent tubes are moved in various predetermined patterns. Disclosures relating to such prior art lighting devices are found in U.S. Pat. Nos. 3,531,636; 2,196,424; 1,108,190; 1,960,618; 2,259,999; 2,063,451; 1,553,902; 2,225,401; 2,136,429, 1,576,219; 2,221,483; and 2,446,333.

A difficulty in constructing such lighting devices having moving, particularly rotating or orbiting light sources, lies in the fact that electric power must usually be provided to the light sources through brushes and rotating slip rings. For this reason, in spite of the extensive efforts of the prior art as evidenced by the above cited patents, certain types of highly decorative and attention inviting continuous motion patterns have not been imparted to decorative or warning lighting devices of the prior art.

In an application for a United States patent having Ser. No. 95,223 filed by Marlowe A. Pichel on Nov. 19, 1979, and assigned to the same assignee as the present invention, a lighting device is described which includes a plurality of high intensity lights continuously moveable in a predetermined rotating or orbiting pattern. Although this lighting device is well adapted for providing aesthetic pleasure and inviting public attention, it still requires the use of slip rings and brushes to provide elecric power to the light sources.

The present invention is directed to a lighting device which overcomes many of the above noted shortcomings of the prior art lighting devices. Furthermore, the lighting device of the present invention in its construction and operation represents a significant advance over the lighting device disclosed in the above referenced United States patent application.

SUMMARY OF THE INVENTION

It is an object of the present invention to provide an improved lighting device which has a plurality of light sources continuously moveable in an aesthetically pleasing unique pattern relative to a stationary base.

It is another object of the present invention to provide an improved highly decorative and attention-inviting lighting device which does not require continuous attendance by an operator.

It is still another object of the present invention to provide an improved highly decorative and attention-inviting lighting device which may be operated on commonly available power company supplied electric power.

It is yet another object of the present invention to provide an improved highly decorative and attention inviting lighting device wherein at least one high intensity light source is capable of an orbiting motion and power is supplied to the same without relatively cumbersome slip rings and brush assemblies.

These and other objects and advantages are attained by an improved lighting device which has a base incorporating at least one bent shaft rotatably mounted to the base. A first portion of the shaft is angularly disposed relative to a second portion. A light source is rotatably mounted to the second portion so that the shaft carries the light source in an orbiting motion without rotating the light source about its own axis. Electric power is supplied to the light source by a flexible cable which is fixedly attached to the base and to the light source. A motor is mounted within the base to rotate the bent shaft about an axis coinciding with the first portion of the shaft.

In most of the preferred embodiments of the invention, a plurality of light sources are provided with each light source being mounted to a different bent shaft in the above described manner. In this case the center point of orbit is different for each light source. Preferably the first portion of the bent shaft is inclined relative to the vertical direction whereby each orbiting light source continuously changes its angular positioning relative to the vertical direction.

The present invention is set forth with particularity in the appended claims. The manner of making and using the present invention may be best understood by reference to the following description of the preferred embodiments, taken in connection with the accompanying drawings in which like numerals indicate like parts.

BRIEF DESCRIPTION OF THE DRAWINGS

FIG. 1 is a perspective view of a first preferred embodiment of the lighting device of the present invention;

FIG. 2 is a top view of the first preferred embodiment of the lighting device of the present invention;

FIG. 3 is a cross sectional view of the first preferred embodiment of the lighting device of the present invention, the cross section being taken on lines 3—3 of FIG. 2;

FIG. 4 is a schematic, partial perspective view showing a portion of a drive mechanism incorporated in the first preferred embodiment of the lighting device of the present invention;

FIG. 5 is a cross sectional view showing a high intensity light source incorporated in the first preferred embodiment of the lighting device of the present invention, the cross section being analogous to one taken on lines 5—5 of FIG. 3;

FIG. 6 is a side view, partly in cross section, of a bent shaft assembly incorporated in the first preferred embodiment of the lighting device of the present invention;

FIG. 7 is a side view of a light source incorporated in a second preferred embodiment of the lighting device of the present invention;

FIG. 8 is a partial side view, partly in cross section, of a light source having colored filters, the light source being incorporated in a third preferred embodiment of the lighting device of the present invention;

FIG. 9 is a schematic top view showing the relative positioning of the four light sources incorporated in the first preferred embodiment of the lighting device of the present invention;

FIG. 10 is a schematic side view showing the relative positioning and movement of the light sources incorporated in the first preferred embodiment of the lighting device of the present invention;

FIG. 11 is a schematic, partial top view showing the relative positioning and movement of two oppositely disposed light sources which are incorporated in the first preferred embodiment of the lighting device of the present invention;

DESCRIPTION OF THE SPECIFIC EMBODIMENTS

Figure 12:
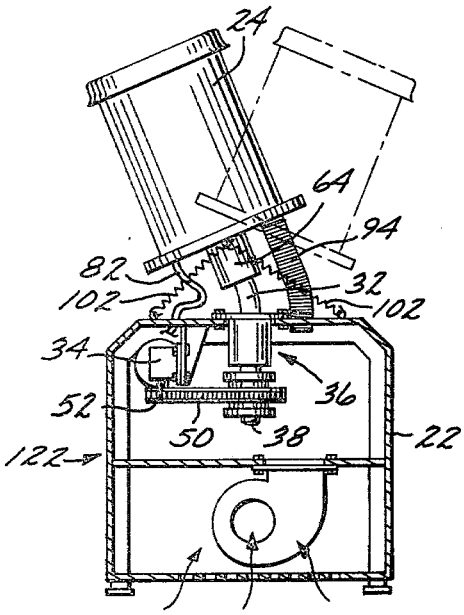
FIG. 12 is a view partly in cross section of a fourth preferred embodiment of the lighting device of the present invention.
Figure 13:
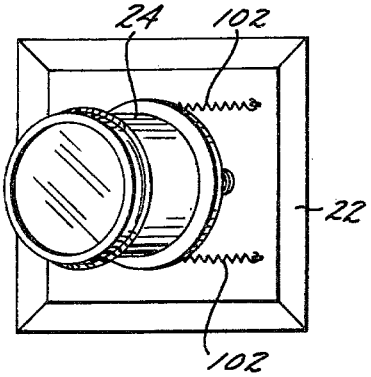
FIG. 13 is a top view of the fourth preferred embodiment of the lighting device of the present invention.

The following specification taken in conjunction with the drawings sets forth the preferred embodiments of the present invention. The embodiments of the invention disclosed herein are the best modes contemplated by the inventor for carrying out his invention in a commercial environment, although it should be understood that various modifications can be accomplished within the scope of the present invention.

Referring now to FIGS. 1 and 3, a first preferred embodiment of the lighting device 20 is disclosed in detail. The lighting device 20 includes a base or support 22 which, for the sake of increased mobility, may be mounted on wheels or casters (not shown). In the first preferred embodiment, the base 22 is sufficiently large to support four high intensity light sources 24 which are positioned above its top surface 26. In addition, a hollow interior portion 28 of the base 22 accommodates a drive mechanism 30 and electric components, circuits, circuit breakers and the like (not shown) which are associated with the light sources 24 and the drive mechanism 30.

Dimensions of the base 22 are dependent on the number and specific nature of the light sources 24. It should be clearly understood at the outset however, that neither the number nor the nature of the light sources 24 are critical for the purpose of practicing the present invention. In the herein described first preferred embodiment four light sources 24 are utilized which emit a high intensity light beam 31. When projected into the night sky, the high intensity light beam 31, schematically shown on FIG. 1, is conspicuous and visible from a considerable distance.

Preferably, each light source 24 incorporated in the herein described preferred embodiments has a power input of approximately 1000–6000 watts. This power input is ideal from the standpoint that it is capable of providing a highly visible bright light beam, while still permitting the lighting device 20 to be operated at the usually available 240 V or 120 V AC current. High intensity lights of the xenon type specifically shown on FIG. 5 and briefly described in conjunction therewith, are particularly well-suited for incorporation in the lighting device 20 of the present invention.

Thus, the lighting device 20 of the present invention is usually not dependent on power generated by an associated portable generator (not shown). Nevertheless, a portable generator (not shown) may be used for supplying a power to the lighting device 20 when commercial power is not readily available. Absence of a hydrocarbon fueled generator greatly reduces the need for the continuous presence of an operator when the lighting device 20 is in use. As it is described further below, the lighting device 20 of the present invention may be remotely controlled, and therefore readily operated without the presence of an operator.

Referring again to FIGS. 1, 2 and 3 and particularly to FIG. 3, mounting of the light sources 24 to the base 22 and operation of the drive mechanism 30 of the first preferred embodiment is explained in detail. Each individual light source or high intensity lamp 24 is mounted to a bent shaft 32 which protrudes from the interior portion 28 of the base 22 through its top surface 26.

An electric motor 34, shown on FIG. 3, is mounted to the interior 28 of the base 28. The electric motor 34 drives the bent shaft 32 which is itself incorporated in a bent shaft assembly best described with reference to the detailed drawing of FIG. 6. Thus, a first bent shaft assembly 36 includes the bent shaft 32 which has two portions. A first portion 38 of the bent shaft 32 is contained within the interior 28 of the base 22. As shown in FIG. 3, the first portion 38 of the bent shaft 32 is disposed at an angle relative to the vertical.

The bent shaft 32 is rotatably held by two ball bearings 40 which, in turn, are fixedly held relative to the base 22 in a tubular bearing housing 42. The bearing housing 42 is directly attached to a top cover plate 44 of the base 22. In the herein described first preferred embodiment, the two ball bearings 40 provide the chief means of support for the entire bent shaft 32 and to the light source of high intensity lamp 24 which is mounted to the bent shaft 32.

As is shown on FIG. 6, a first sprocket 46 and a second sprocket 48 are mounted below the bearing housing 42 upon the first portion of the bent shaft 32. The first sprocket 46 engages a chain 50, shown in FIGS. 3 and 4, which transmits to the bent shaft 32 the rotary motion of an output shaft 52 of the electric motor 34. The output shaft 52 of the motor 34 is shown on FIG. 3. An upper bushing 54 and a lower bushing 56 are mounted to the first portion 38 of the bent shaft 32 so as to fix the positioning of the first and second sprockets 46 and 48. The second sprocket 48 interfaces with a timing belt 58, shown on FIGS. 3 and 4, and drives three more bent shaft assemblies 60 each of which carries and moves one of the light sources or high intensity lamps 24. An explanation of the operation of the timing belt 58 to synchronize movement of the light source 24 in a desired manner is given below in conjunction with the description of FIG. 4.

Referring again to FIGS. 3 and 6, mounting of the light source 24 to a second portion 62 of the bent shaft 32 is dislcosed. The second portion 62 of the bent shaft 32 is located outside of the interior 28 of the base 22 and one end thereof is attached to the first portion 38 of the bent shaft 32. As is clearly discernible on FIG. 6, the second portion 62 is angularly disposed relative to the first portion 38. In the herein described first preferred embodiment, the first and second portions 38 and 62 of the bent shaft 32 define the same acute angle as the acute angle which is defined by the angular disposition of the first portion 38 of the bent shaft 32 relative to the vertical direction. In other words, the first portion 38 of the bent shaft 32 deviates from the vertical direction by an acute angle designated $\alpha$, and the second portion 62 of the bent shaft 32 deviates from the first portion by the same acute angle $\alpha$. More specifically, in the herein described first preferred embodiment, the first portion 38 of the bent shaft 32 deviates from the vertical direction by 22.5°, and therefore $\alpha=22.5°$.

Still referring to FIG. 6, a second bearing housing 64 is shown which is fixedly attached to the light source or high intensity lamp 24. Two ball bearings 66 are mounted in the second bearing housing 64. The ball bearings 66 also engage the second portion 62 of the bent shaft 32 so that the bent shaft is free to rotate independently from the light source 24.

Each of the four light sources 24 of the herein described first preferred embodiments are associated with one bent shaft assembly similar to the above described first bent shaft assembly 36. The other bent shaft assemblies 60 differ from the first bent shaft assembly 36 only in that they do not include a first sprocket 46 for the receipt of a driving chain 50 associated with the electric motor 34. Instead, the three other bent shaft assemblies 60 are driven by the timing belt 58 which engages the second sprocket 48 of each respective bent shaft assembly 60.

As is best shown on the schematic view of FIG. 4, the endless timing belt 58 is led around idler rollers 68, one of which is respectively positioned between each second sprocket 48. The idler rollers 68 allow the timing belt 58 to undergo a certain twisting which is necessary because the four interconnected second sprockets 48 are not in a coplanar configuration relative to one another.

With reference to the cross sectional view of FIG. 5, a detailed structure of each light source or high intensity lamp 24 of the first preferred embodiment of the present invention is shown and described. The high intensity lamp 24 includes a substantially cylindrically shaped lamp housing 70 which has a bottom plate 72. The bearing housing 64, which attaches the bent shaft 32 for free rotation relative to the high intensity lamp 24, is fixedly mounted to the bottom plate 72. The bottom plate 72 includes suitable openings for introduction of electrical power and a supply of cooling air into the interior of the lamp housing 70.

A high intensity short arc xenon lamp 74 is mounted within the housing 70. The xenon lamp 74, which is manufactured according to standard practice in the art, includes two electrodes 76 mounted in a suitably shaped glass envelope 78. The glass envelope 78 also contains xenon gas. Direct current electrical voltage is applied to the electrodes 76 through contacts 80 and cables 82, one of which is shown on FIG. 5.

As a result of the applied DC voltage, a very bright short electric arc is formed between the electrodes 76 in the xenon lamp. The short electric arc approximates, as closely as practically possible, a dimensionless source of light rays, and the xenon lamp 74 is positioned so that the arc is in the focal point of a parabolic mirror 84. Consequently, a light beam which is projected outwardly by the parabolic mirror 84 consists essentially of parallel disposed light rays. The direction of these light rays coincides with a general longitudinal axis 85 of each light source 24. In the herein described preferred embodiments of the present invention, the mirror 84 is manufactured by an electroforming process which results in a very high optical quality parabolic surface.

In order to provide efficient cooling to the heat generating xenon lamp 74, a first venturi tube 86 and a second venturi tube 88 are mounted to the lamp housing 70 so as to immediately surround the electrodes 76 with a continuous air flow. The air flow is provided by a fan 90, schematically shown on FIG. 3, which draws outside air into the interior 28 of the base 22 through openings 92 provided in the base 22. The air driven by the fan 90 is then led through flexible ducts 94 into the lamp housing 70 of each light source 24 wherein the airflow is indicated by arrows on FIG. 5.

An open cell plastic foam seal 96 is provided between the lamp housing 70 and a substantially flat glass plate 98 which covers the lamp housing 74. Warm air is exhausted from the lamp housing 70 through the plastic foam seal 96.

A tubular extension 100, preferably made of anodized aluminum is optionally attached to the lamp housing 70 of each light source 24 as is shown on FIG. 5. The tubular extensions 100 enhance the aesthetic appearance of the lighting device 20, and help prevent curious onlookers from looking directly into the light sources 24 or tampering with the xenon lamps 74. The optionally provided tubular extensions are only shown on FIG. 5.

Having described the principal structural components of the first preferred embodiment of the lighting device 20 of the present invention, its operation is explained with particular reference to FIGS. 3, 4, 9, 10 and 11.

As the light sources 24 are energized, a very bright beam of light 31 is projected in a direction substantially parallel with the general longitudinal axis of each light source 24. The electric motor 34 rotates all four bent shafts 32 through the chain 50 and the timing belt 58. As the bent shaft 32 rotate, each light source 24, attached to a respective second portion 62 of the bent shaft 32, is caused to underdgo an orbiting motion around a circle. The center of each circle is geometrically located on a line defined by the first portion 38 of the respective bent shaft 32. It is readily apparent from the above description and from an inspection of the drawing figures that the plane of orbit of each light source 24 is inclined relative to the vertical and horizontal direction.

Because of the above described particular geometry of each bent shaft 32, during a full circle of its rotation each light source 24 gradually changes its angular positioning in the following manner. Initially each light source is in a vertical position which is shown on FIG. 3, and also, with full lines, on the highly schematic views of FIGS. 9 and 11.

As each bent shaft 32 rotates and the corresponding light source 24 moves in its orbit away from its fully vertical position, its angular disposition continuously increases relative to the vertical until at the end of a first half of its circular orbit a 45° angle is reached. Two light sources 24 in an inclined 45° position are shown by dotted lines on the highly schematic view of FIG. 10. Thereafter, during the second half of its circular orbit each light source 24 moves to gradually decrease its angular disposition until at the end of the circle each light source 24 is once again disposed substantially vertically.

Generally speaking, when the angular disposition of the first portion 38 of the bent shaft 32 relative to the vertical is an acute angle designated $\alpha$, and the angular disposition of the second portion 62 of the shaft 32 to its first portion 38 is also $\alpha$, then during a full circle of orbit each light source 24 changes its angular disposition between substantially 0° to the vertical to $2\alpha°$ to the vertical.

A 22.5° angular disposition of the bent shaft 32 to the vertical, as is provided in the first preferred embodiment, is particularly advantageous for aesthetic reasons. In this case, each light beam 31 is lowered 45° relative to the vertical direction. This feature renders the lighting device 20 highly conspicuous without unduly directing the bright light beam upon members of the public who view the lighting device 20 of the present invention from a relatively close distance. It should be expressly understood however, that the angle $\alpha$ may vary between a very low angle such as approximately 5° up to approximately 45°, or even higher. In the case the bent shaft 32 is positioned at 45° relative to the vertical direction, each light source 24 reaches a substantially horizontal positioning at the lowest point of its respective orbit.

As is stated above in conjunction with the description of FIG. 3, each light source 24 is mounted through the ball bearings 66 to the bent shaft. A plurality of springs 102 are attached to a flange 104 provided in the bottom of each light source 24 and a flange 104 of another light source 24 as is shown on FIGS. 1 and 2. The springs 102 help to balance and support the light sources 24 while the same are in motion. The springs 102, perhaps more importantly, also prevent the light sources 24 from rotating about their own respective longitudinal axis as they are moved in orbit by the bent shafts 32. Since the light sources 24 are not actually rotating, it is possible in the present invention to eliminate slip rings, brushes (not shown), and the like. In the present invention, electrical power and cooling air is simply provided to the light sources by the flexible cables 82 and the flexible ducts 94 best shown on FIG. 3.

It should be understood and appreciated that prevention of rotation of the light sources 24 about their respective longitudinal axes is an advantageous feature of the present invention. It greatly reduces the complexity of the structure and hence the cost of the lighting device 20 of the present invention. The springs 102 which act in conjunction with the ball bearings 66 to prevent rotation of the light sources 24 need not, however, interconnect two light sources 24. In alternative embodiments, particularly where the number of light sources 24 of the lighting device 20 is an odd number, the springs 102 or like fastening and load bearing devices may be fixedly attached to a respective light source 24 on the one hand and to the base 22 on the other hand.

It should be readily apparent from the above description that synchronization of movement of the several light sources 24 of the lighting device 20 may be readily accomplished by adjusting the positioning of the second sprockets 48, the bent shafts 32 and the timing belt 58 relative to one another. Generally speaking, it is preferred, although not required, that all light sources 24 of the device 20 move in a synchronized fashion in the sense that they occupy their respective vertical and their lowest positioning relative to the vertical direction at the same time.

The first preferred embodiment of the lighting device 20 of the present invention is adjusted to function in the above described preferred manner. Thus, all four light sources 24 of the first preferred embodiment occupy the vertical position at the same time. In their vertical configuration the light sources 24 are closest to one another. Therefore, the lighting device 20 is best transported and stored in this configuration. The orbiting movement of the oppositely disposed two light sources 24 is directionally opposite to one another, as is shown on FIG. 11. Moreover, all four light sources 24 reach a 45° angle positioning relative to the vertical direction at the same time, as is schematically shown on FIG. 9.

It is readily apparent that the above described movement of the light sources 24 provides an interesting, aesthetically pleasing and highly attention-inviting lighting display. This lighting display is very well-suited for attracting members of the public to movie theaters, shows, shopping centers and like places.

Referring now to FIG. 7, mounting of a light source 24 in a second preferred embodiment of the present invention is disclosed. A support plate 106 is mounted through the bearing housing 64 and ball bearings 66 to the second portion 62 of the bent shaft 32 so that the bent shaft 32 may rotate independently of the rotation of the support plate 106. In this regard it is noted that the bearing housing 64 of the second embodiment is constructed in the same manner as is shown in detail on FIG. 6 for the first preferred embodiment. A mounting post 108 is attached to the support plate 106 and the light source 24 is pivotably mounted to the mounting post 108. A wing nut 110 shown on FIG. 7 indicates that inclination of the light source 24 relative to the mounting post 108 is individually adjustable for each light source 24. Thus, in the second preferred embodiment, each light source 24 may be individually adjusted to have a desired inclination relative to the vertical direction even when the second portion 62 of the bent shaft 32 is in a substantially vertical disposition.

Referring now to FIG. 8, a plurality of color filters 112 are shown incorporated into the tubular extension 100 which is mounted to each lamp housing 70 of the third preferred embodiment. Although only two color filters 112 are shown on FIG. 8, it should be expressly understood that any desired number of color filters 112 may be provided within the scope of the present invention. The color filters 112 work similarly to the functioning of a butterfly valve; i.e. in their open position they are substantially aligned with the parallel rays of lights and interfere only minimally with the flow of light in the tubular extension 100. In their closed position, however, the filters 112 effectively color the light emitted from the light source 24. Closing and opening of the color filters 112 is accomplished by actuating solenoids 114 which respectively interconnect with the color filters 112 through respective bell crank mechanisms 116. A spring 118 mounted to the outside of the tubular extension 100 keeps each color filter 112 in the open position when the solenoid 114 is not activated. Suitable protrusions or stops 120 are provided in the interior of the tubular extensions 100 to properly align each color filter 112 either in an open or closed position. Only the stops 120 capable of aligning one of the color filters 112 in a closed position are shown on FIG. 8. Instead of translucent colored filters 112, a nontransparent object may also be provided to temporarily black out light emitted from any of the respective light sources 24.

The several color filters 112 associated with the light sources 24 of the third preferred embodiments of the present invention may be electronically controlled even from a remote location to give a practically infinite variety of lighting effects by continuously changing color in predetermined patterns. In this regard, it is noted that a display of moving and changing colored light in the night sky is particularly attractive when the colored lights are reflected by a low cloud bank.

Referring now to FIG. 12, a fourth preferred embodiment 122 of the lighting device of the present invention is disclosed. The fourth preferred embodiment 122 is, in many respects, similar to the first preferred embodiment. Thus, the fourth preferred embodiment includes a stationary base 22 containing an electric motor 34, which drives a bent shaft assembly 36.

A principal difference between the fourth preferred embodiment 122, as well as the hereinafter described fifth and sixth preferred embodiments on the one hand and the first preferred embodiment on the other hand, is that in the fourth, fifth and sixth preferred embodiments, only one light source or high intensity lamp 24 is mounted to the base 22.

In the fourth preferred embodiment 122 the bent shaft assembly 36 is substantially identical in construction with the bent shaft assembly 36 described in detail in conjunction with FIG. 6. Since in the fourth preferred embodiment 122 only one light source 24 is used, no timing belt is attached to the bent shaft assembly 36. A chain 50 interconnects the bent shaft assembly 36 with the electric motor 36 and rotates the bent shaft 32.

As in the first preferred embodiment, the light source or high intensity lamp 24 is mounted through a second bearing housing 64 to a second portion 62 of the bent shaft 32. Consequently, the rotating bent shaft 32 carries the light source 24 in an orbit, the center point of which is on the geometrical line defined by a first portion 38 of the bent shaft 32. During its orbiting motion the light source 24, however, does not rotate about its own longitudinal axis. For this reason, electric power and cooling air can be supplied to the light source 24 through a flexible cable 82 and a flexible duct 94, respectively.

A plurality of springs 102, two of which are shown on FIG. 12, interconnect the light source 24 and the base 22. The springs 102 help to balance and support the orbiting light source 24 and prevent its rotation.

Figure 15:
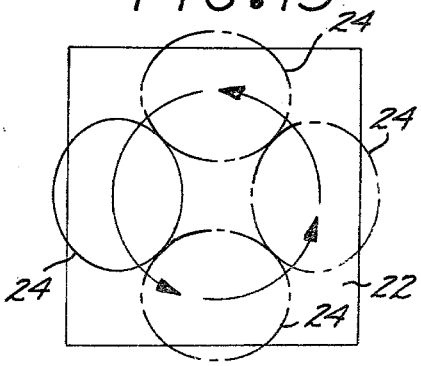
FIG. 15 is a schematic top view showing the movement of the single light source of the fourth preferred embodiment of the lighting device of the present invention.

Another principal difference between the fourth preferred embodiment 122 of the lighting device of the present invention and the previously described preferred embodiments is that in the fourth preferred embodiment 122, the first portion 38 of the bent shaft 32 is substantially vertically disposed. Consequently, the plane of orbit of the light source 24 is substantially horizontal and during the entire orbit of the light source 24 the emitted parallel rays of light describe the same angle relative to the vertical direction. This angle, of course, is determined by the angular disposition of the first portion 38 of the bent shaft 32 relative to the second portion 62. The highly schematic view of FIG. 15 shows the light source 24 of the fourth preferred embodiment 12 in four different positions during its orbit.

Figure 14:
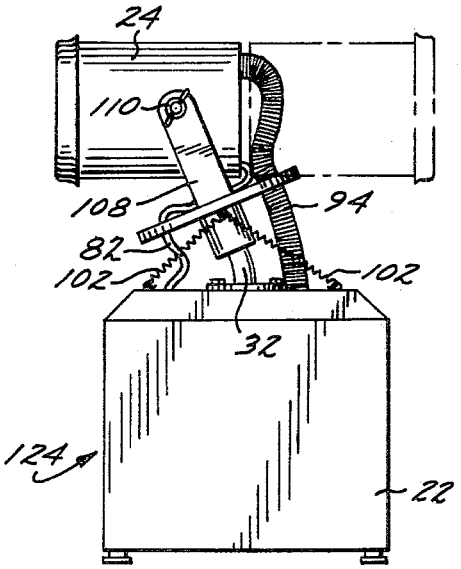
FIG. 14 is a side view of a fifth preferred embodiment of the lighting device of the present invention.

Referring now to FIG. 14, a fifth preferred embodiment 124 of the lighting device of the present invention is disclosed. The fifth preferred embodiment 124 is very similar to the fourth preferred embodiment 122 except that in the fifth preferred embodiment 124 the light source 24 is pivotably mounted to a mounting post 108 which is carried in orbit by the bent shaft 32. Thus, in the fifth preferred embodiment 124, as in the previously described second preferred embodiment, the angular positioning of the light source 24 is adjustable by loosening and subsequent tightening of a wing nut 110.

Figure 16:
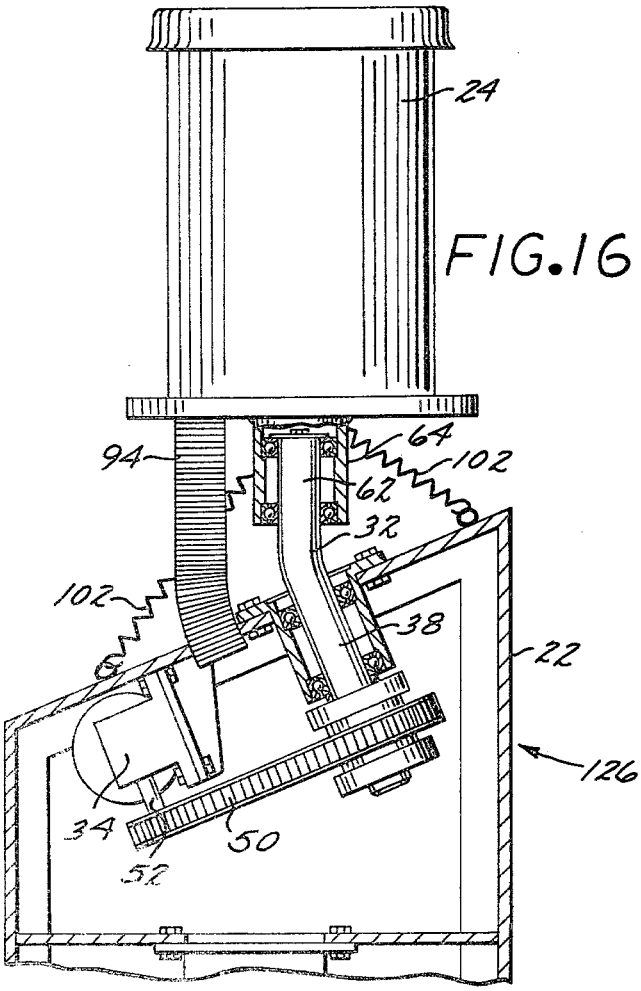
FIG. 16 is a side view partly in cross section of the sixth preferred embodiment of the lighting device of the present invention.

FIG. 16 discloses a sixth preferred embodiment 126 of the lighting device of the present invention. In the sixth preferred embodiment 126 a single light source 24 is mounted to the base 22 through a bent shaft assembly 36 wherein a first portion 38 of the bent shaft 32 is angularly disposed relative to the vertical direction. Thus, in the sixth preferred embodiment 126, as in the first preferred embodiment, the angular positioning of the light source 24 relative to the vertical direction continuously changes as the light source 24 orbits in a plane which is inclined relative to the vertical direction.

It should be expressly understood that the fourth, fifth and sixth preferred embodiments of the lighting device of the present invention may also be provided with color filters as is described above in conjunction with the third preferred embodiment. Still further modifications of the several embodiments of the herein described lighting devices may become readily apparent to those skilled in the art in light of the above disclosure. Therefore, it is to be understood that, within the scope of the appended claims, the invention may be practiced other than as specifically described therein.

I claim:

1. A lighting device comprising:

a base;

a plurality of light sources, each light source being mounted to the base;

first means mounted to the base for individually varying angular positioning of each light source relative to the vertical direction and for simultaneously causing each light source to orbit a respective centerpoint without causing rotation of each light source about an axis.

2. The invention of claim 1 wherein the first means orbit each light source in a circular path in a plane describing an angle other than 90° with the vertical direction.

3. The invention of claim 2 wherein the first means include a motor and a plurality of rotating shafts operatively associated with the motor and rotated thereby, each rotating shaft having a fixed axis of rotation relative to the base, a first portion substantially coinciding with the axis of rotation and a second portion angularly disposed relative to the first portion, said second portion bearing one light source.

4. The invention of claim 3 wherein the first portion of each shaft is mounted to define a predetermined acute angle relative to the vertical direction, said angle having a value $\alpha$; the second portion of each shaft is disposed substantially at an angle of $\alpha$ relative to the first portion of the shaft whereby during each full circle of rotation of each shaft the second portion of each shaft momentarily occupies a substantially vertical position and also a position wherein it is disposed substantially at an angle of $2\alpha$ relative to the vertical direction.

5. The invention of claim 4 wherein $\alpha$ is in the range of 5°–45°.

6. The invention of claim 5 wherein $\alpha$ is approximately 22.5°.

7. The invention of claim 4 wherein the second portion of each shaft is mounted to the respective light source so that said second portion of each shaft may freely rotate relative to said light source, and wherein second means are operatively associated with each light source for preventing rotation of each light source about its general longitudinal axis whereby each light source orbits the respective center point when carried by the second portion of the respective rotating shaft without rotating about its axis.

8. The invention of claim 7 wherein the second means comprise a plurality of springs, each light source being interconnected with at least one other light source by at least one spring.

9. The invention of claim 7 further including a plurality of flexible wire cables for providing electric power to the light sources, at least one wire cable connecting the base with one of the light sources, and wherein at least one flexible duct supplies cooling air to each light source.

10. The invention of claim 4 wherein each light source is mounted to the second portion of each shaft to have a variable adjustable angular positioning thereon.

11. The invention of claim 4 wherein the light sources are high intensity light sources adapted for projecting a beam of light which substantially consists of parallel rays of light.

12. The invention of claim 11 wherein the direction of the parallel rays of light substantially coincides with a general longitudinal axis of the respective light source, and wherein said general longitudinal axis is disposed at an angle of $\alpha$ relative to the first portion of the respective rotating shaft.

13. The invention of claim 4 wherein the light sources are high intensity light sources.

14. The invention of claim 13 wherein a power input of each light source is approximately in the 1000–6000 W range.

15. The invention of claim 4 wherein at least one color filter is mounted to each light source, and wherein third means are provided to optionally place the color filter in the path of the light beam emitted by the respective light source.

16. A device adapted for gathering public attention by a display of high intensity lights, the device comprising:

a base;

a plurality of high intensity light sources movably mounted to the base and adapted for projecting a beam of light essentially consisting of parallel rays of light;

at least one motor mounted to the base;

a plurality of rotating shafts mounted to the base operatively associated with and driven by the motor, each shaft having a first portion and a second portion angularly disposed relative to the first portion, the first portion being substantially aligned with the respective axis of rotation of the shaft, the second portion bearing one light source in an angularly fixed relationship relative to the second portion, the light source being rotatably mounted to the second portion of the shaft, and means operatively associated with each light source for preventing each light source from rotating about its own axis whereby each light source orbits in a substantially circular path having a plane of orbit other than a horizontal or vertical plane, each light source has a center of orbit different from the center of orbit of the other light sources, each light source continuously changes angular positioning of its parallel rays of lights relative to the vertical direction and none of the light sources rotate about their respective axis while they orbit.

17. The invention of claim 16 wherein each light source is mounted to the respective shaft so that its angularly fixed relationship relative to the second portion of the shaft is adjustable.

18. The invention of claim 16 wherein each shaft has a sprocket fixedly mounted thereto and wherein the shafts are driven by the motor through an endless timing belt which engages said sprockets.

19. The invention of claim 16 wherein the respective axis of rotation of each shaft describes a predetermined acute angle $\alpha$ relative to the vertical direction, and wherein the second portion of the shaft describes the same angle $\alpha$ relative to the first portion of the shaft, whereby during a full circle of rotation of each shaft the angular positioning of the second portion of the shaft varies between substantially 0° to the vertical to substantially $2\alpha$° to the vertical.

20. The invention of claim 19 wherein the angularly fixed relationship of each light source relative to the shaft is such that parallel rays of light vary between 0° and $2\alpha$° relative to the vertical direction during full revolution of the shaft.

21. The invention of claim 16 wherein the second means comprise a plurality of springs, each light source being connected to at least one other light source by at least one spring.

22. In a device adapted for gathering public attention by a display of a plurality of high intensity light beams having substantially parallel disposed light rays, said device including a base member and a plurality of high intensity light sources mounted to the base member, the improvement comprising:

first means for individually orbiting each light source around a centerpoint of orbit which is different for each light source and for continuously changing angular positioning of the light rays of each light source relative to the vertical direction while the light sources are in orbit, the first means also being adapted for preventing rotation of each light source about its own axis while the respective light source is in orbit whereby current may be supplied to each light source without the use of slip rings, brushes and the like.

23. The improvement of claim 22 wherein the first means are adapted for varying the angular positioning of the parallel light rays of each light source approximately between 0°–90° relative to the vertical direction.

24. The improvement of claim 23 wherein the first means are adapted for varying the angular positioning of the parallel light rays of each light source approximately between 0°–60° relative to the vertical direction.

25. The improvement of claim 23 wherein there are at least three light sources.

26. The improvement of claim 25 wherein there are at least four light sources, and wherein direction of orbit of two light sources is clockwise and of the other two light sources is counterclockwise.

27. The improvement of claim 22 wherein the first means comprise a plurality of rotating bent shafts driven by motor means mounted in the base member, each rotating bent shaft having a first portion in substantial alignment with the respective axis of rotation of the bent shaft and in an angular position relative to the vertical direction, and a second portion which is angularly disposed relative to the first portion, the second portion of each shaft bearing and carrying a respective light source which is rotatably mounted thereto, and wherein the first means further comprise at least one flexible connecting member connecting each light source with one of the base and the other light sources.

28. The improvement of claim 27 wherein the angular disposition of the second portion of each bent shaft relative to its first portion is the same angle $\alpha$ as the angular disposition of the first portion of each bent shaft relative to the vertical direction whereby the first means are adapted for changing the angular positioning of the light rays of each light source during a single revolution of each bent shaft substantially between 0° to $2\alpha$° to the vertical.

29. The improvement of claim 28 further comprising timing and transmission means for causing the respective beams of all light sources to simultaneously reach a substantially vertical position.

30. The improvement of claim 29 wherein the timing and transmission means comprise a plurality of sprockets, and an endless timing belt, one sprocket being mounted to each bent shaft, the endless belt engaging the respective sprockets of each bent shaft.

31. A device adapted for inviting public attention by a continuously moving display of at least one light, the device comprising:

a base;

a bent shaft mounted to the base for rotation relative to the base, the bent shaft having a first portion being in substantial alignment with the axis of rotation of the bent shaft, and a second portion being angularly attached to the first portion;

motor means mounted in the base for rotating the bent shaft;

a light source rotatably mounted to the second portion of the bent shaft so that the light source is carried by the rotating bent shaft in a plane of orbit a center point of which coincides with the first portion of the bent shaft, and so that the light source does not rotate about an axis as it is carried in orbit by the bent shaft.

32. The invention of claim 31 wherein the light source is a high intensity light source and is adapted for projecting a beam of light consisting essentially of parallel disposed rays of light.

33. The invention of claim 32 wherein a power input of the light source is at least approximately 1000 watts.

34. The invention of claim 31 wherein the first portion of the bent shaft is substantially vertically disposed so that the plane of orbit of the light source is substantially horizontally disposed.

35. The invention of claim 31 wherein the light source is mounted to the second portion of the bent shaft so that the angular positioning of the light source to the bent shaft is adjustable.

36. The invention of claim 31 wherein the first portion of the bent shaft is disposed at a predetermined angle $\alpha$ relative to the vertical direction, whereby the plane of orbit of the light source is inclined relative to the vertical direction.

37. The invention of claim 36 wherein the second portion of the bent shaft is disposed relative to the first portion at the angle $\alpha$ whereby an angular positioning of the light source relative to the vertical direction is continuously varied as the light source orbits substantially between $2\alpha$ and zero degrees.

38. The invention of claim 37 wherein $\alpha$ is an acute angle in the range of 5°–45°.

39. The invention of claim 38 wherein $\alpha$ is approximately 22.5°.

40. The invention of claim 31 wherein the light source is mounted to the second portion of the bent shaft through at least one bearing.

41. The invention of claim 31 wherein the light source is attached to the base by an elastic member whereby rotation of the light source about an axis is prevented.

42. The invention of claim 41 wherein power is supplied to the light source through a flexible cable, the flexible cable being fixedly connected to the light source and to the base.

43. The invention of claim 42 wherein cooling air is supplied to the light source through a flexible duct, the duct being fixedly connected to the light source and to the base.

* * * * *

UNITED STATES PATENT AND TRADEMARK OFFICE

CERTIFICATE OF CORRECTION

PATENT NO. : 4,298,911

DATED : November 3, 1981

INVENTOR(S) : Richard T. Headrick

It is certified that error appears in the above-identified patent and that said Letters Patent are hereby corrected as shown below:

Column 1 line 45 delete "of" and insert --or--.

Column 4, line 63 delete "of" and insert --or--.

Column 12, line 44 delete "second".

Signed and Sealed this

*Ninth* Day of *March 1982*

[SEAL]

*Attest:*

GERALD J. MOSSINGHOFF

*Attesting Officer*

*Commissioner of Patents and Trademarks*